US005490797A

United States Patent [19]

Durgin

[11] Patent Number: 5,490,797

[45] Date of Patent: Feb. 13, 1996

[54] MULTIPIN CONNECTOR APPARATUS

[76] Inventor: Bruce I. Durgin, 4825 Tampico Way, San Jose, Calif. 95118

[21] Appl. No.: 184,672

[22] Filed: Jan. 21, 1994

[51] Int. Cl.[6] ..... H01R 13/62

[52] U.S. Cl. ..... 439/310; 439/700

[58] Field of Search ..... 439/246, 252, 439/387, 700, 824, 310, 61, 64, 65, 79, 259

[56] References Cited

U.S. PATENT DOCUMENTS

| | | | |
|---|---|---|---|
| 1,433,397 | 10/1922 | Meyer . | |
| 3,363,220 | 1/1968 | Redd et al. . | |
| 3,406,368 | 10/1968 | Curran . | |
| 3,521,219 | 7/1970 | Ege | 439/246 X |
| 3,944,311 | 3/1976 | Sprenkle et al. | 439/310 X |
| 4,162,816 | 7/1979 | Malsot . | |
| 4,229,061 | 10/1980 | Majors . | |
| 4,265,503 | 5/1981 | Baur | 439/310 X |
| 4,470,100 | 9/1984 | Rebaudo et al. | 439/310 X |
| 4,582,374 | 4/1986 | Conrad et al. . | |
| 5,076,794 | 12/1991 | Ganthier | 439/70 |
| 5,131,851 | 7/1992 | Billger et al. | 439/310 X |
| 5,133,680 | 7/1992 | Watson et al. | 439/824 |
| 5,151,040 | 9/1992 | Tanaka | 439/73 |
| 5,205,753 | 4/1993 | Butterfield et al. | 439/310 X |
| 5,334,035 | 8/1994 | Wehrle et al. | 439/252 X |

*Primary Examiner*—Khiem Nguyen
*Attorney, Agent, or Firm*—David H. Jaffer

[57] ABSTRACT

A multipin connector assembly including a female connector assembly having a body containing a plurality of pin-receiving receptacles, the openings thereto being frusto-conical in configuration for guiding the pins of a male connector assembly into the receptacles to make contact with electrically conductive, spring-loaded contactors contained therein. Elongated jaws slidably mounted on either side of the body are provided with hooked extension ends extending beyond the front surface of the housing for engaging the male connector assembly and for providing partial alignment of the connectors. Levered clamps mounted to the body provide a leveraging force for drawing the connectors together and locking them in a connected relationship. Each receptacle of the female connector has an alignment bore for directing an entering contact pin into engagement with an angular end surface of the resilient contactor. A slight sliding motion of the pin tip against the angular contact surface results in a frictional engagement which tends to overcome any buildup of oxide on either contact surface and thereby enhances the probability of proper electrical contact. An alternative embodiment of the invention includes a positioning block slidably mounted to a base plate for positioning a female connector assembly relative to a male connector assembly that is mounted either directly to the base plate or to a test card or circuit board which in turn is mounted to the base plate.

23 Claims, 5 Drawing Sheets

82
12
16
52
100
102
138
104
136
106
134
132
126
124
108
56
112
110
114
SECTION 1
107
130
58
128
62
116
14
32
120
74

60
122

MULTIPIN CONNECTOR APPARATUS

BACKGROUND OF THE INVENTION

1. Field of the Invention

The present invention relates generally to multipin connectors, and more particularly to a multipin connector system providing improved alignment of connector pins with receptacles, and still more particularly to an apparatus for overcoming the significant mechanical resistance encountered when mating a multipin connector system, and further to a novel receptacle and pin connection apparatus providing a means for overcoming oxide barrier build up on mating connector surfaces, and thereby improving the probability of successful electrical connection.

2. Description of the Prior Art

Multipin connectors in the prior art require substantial application of force for mating as a result of using pins which engage with receptacles of the common split sleeve configuration. The split sleeve receptacle is an elongated tubular device that is slotted and tensioned so that when a mating connector pin is forced within the tube, the tensioned sleeve rides along the pin and creates an electrical contact. The friction between the pin and the sleeve multiplied by the number of pins in a multipin connector result in a substantial force being required for interconnection.

Alignment of the connector pins with the receptacles is accomplished in the prior art through the tolerancing of the dimensions between the male and female parts. In the event of a pin to receptacle misalignment, caused for example by part distortions or an angular misalignment of the connectors during mating, a pin may make first contact with the end of one of the delicate sleeves. The operator forcing the connectors together may not realize that a misalignment is causing a destructive interference between a pin and a receptacle, because the normal mating force is so substantial that the additional force required to overcome the misalignment and cause damage to the delicate split sleeve might not be noticed.

A common prior art multipin connector provides connection assistance through the use of bolts on either side of the connector, but provides no aid in aligning the connector pins during mating, and requires the use of both hands in a dexterous manner to draw the connectors together uniformly. Any misalignment between the pins and receptacles can cause damage.

There is a need for a multipin connector assembly system that provides mechanical leverage assistance in mating connectors, and at the same time aligns the pins with receptacles in a way that avoids damage.

SUMMARY OF THE INVENTION

It is therefore an object of the present invention to provide a multipin connector assembly that aids in the alignment of the connector pins with receptacles.

It is a further object of the present invention to provide a multipin connector assembly that provides a significant mechanical advantage during the mating process.

It is a still further object of the present invention to provide a multipin connector assembly having a receptacle structure that can straighten mating connector pins and guide them to receptacle contacts in a way that avoids damage.

It is another object of the present invention to provide a multipin connector assembly having a body including receptacles containing spring loaded conductive elements in a novel arrangement that provides a frictional engagement that overcomes the buildup of oxide layers to enhance the probability of a proper electrical contact.

Briefly, a preferred embodiment of the present invention includes a female connector assembly having a body containing a plurality of pin-receiving receptacles, the openings thereto being frusto-conical in configuration for guiding the pins of a male connector assembly into the receptacles to make contact with electrically conductive, spring-loaded contactors contained therein. Elongated jaws slidably mounted on either side of the body are provided with hooked extension ends extending beyond the front surface of the housing for engaging the male connector assembly and for providing partial alignment of the connectors. Levered clamps mounted to the body provide a leveraging force for drawing the connectors together and locking them in a connected relationship. Each receptacle of the female connector has an alignment bore for directing an entering contact pin into engagement with an angular end surface of the resilient contactor. A slight sliding motion of the pin tip against the angular contact surface results in a frictional engagement which tends to overcome any buildup of oxide on either contact surface and thereby enhances the probability of proper electrical contact.

An alternative embodiment of the invention includes a positioning block slidably mounted to a base plate for positioning a female connector assembly relative to a male connector assembly that is mounted either directly to the base plate or to a test card or circuit board which in turn is mounted to the base plate.

An advantage of the present invention is that it provides an aid for engaging the pins and receptacles of a multi-pin connector by holding them in an aligned position, avoiding misalignment and damage.

Another advantage of the present invention is that it enables a user to connect and disconnect in an easier and more rapid manner.

A further advantage of the present invention is that it includes a clamp apparatus that provides a uniform and substantially effortless interconnection.

A still further advantage of the present invention is that it provides a multi-pin connector system that reduces the potential for damage to the pins and receptacles of the mating assemblies.

Another advantage of the present invention is that it provides an apparatus for enhancing the probability of successful multipin electrical contact by overcoming oxide barriers between mating parts.

These and other objects and advantages of the present invention will no doubt become apparent to those skilled in the art after having read the following detailed description of the preferred embodiments which are illustrated in the several figures of the drawing.

IN THE DRAWING

Figure 4:
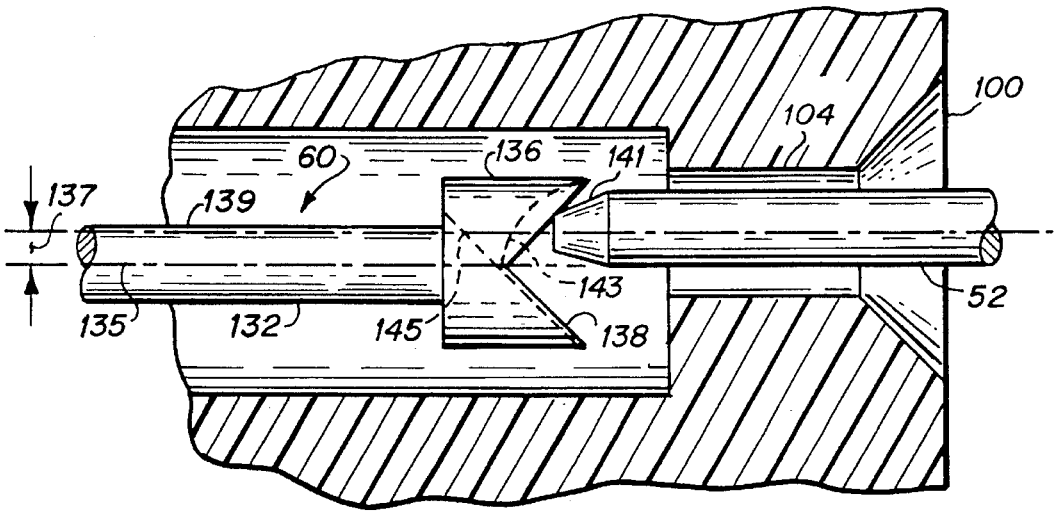
Figures 3A, 3B:
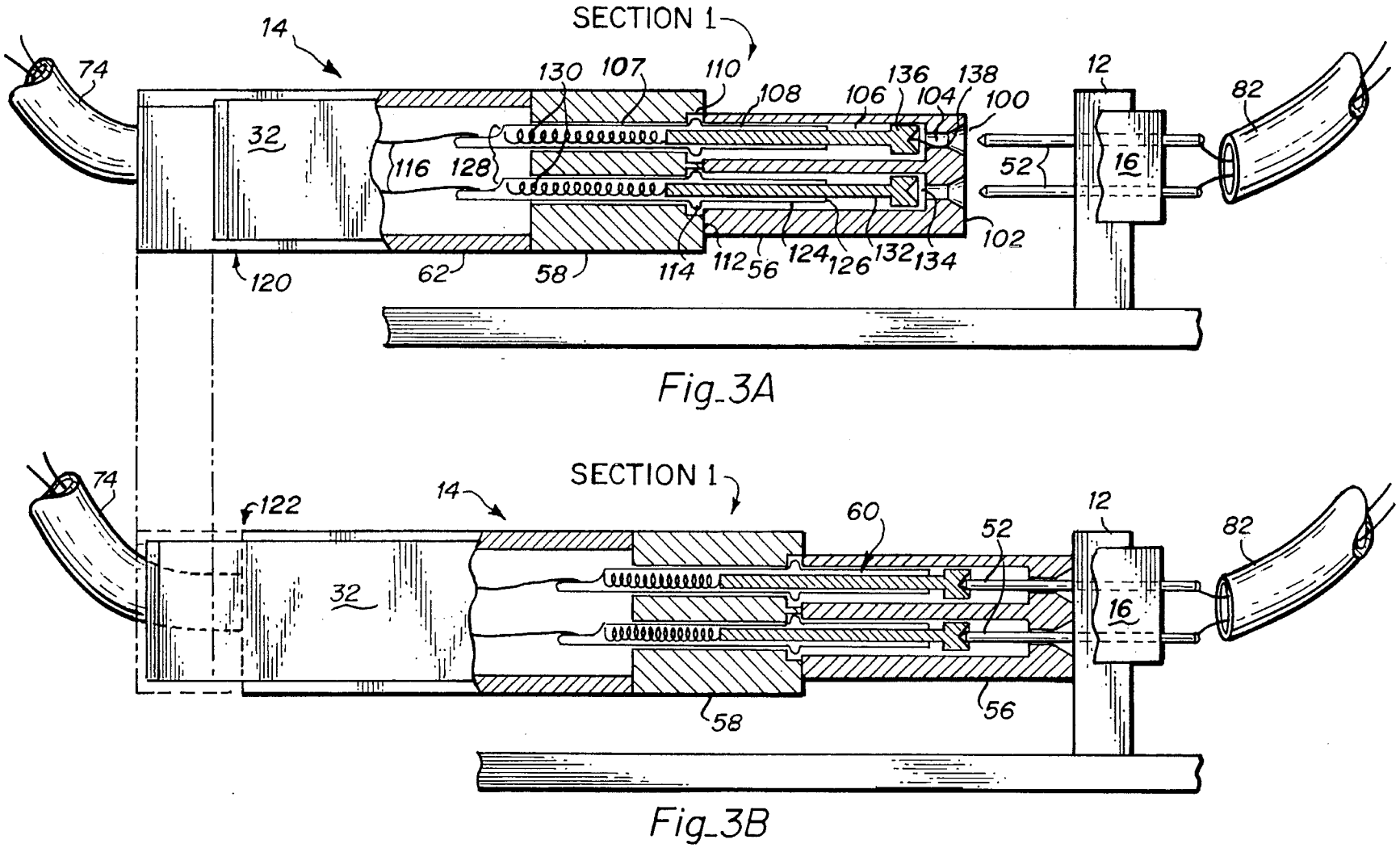
FIG. 3A is a partially broken cross-sectional view of the female connector assembly taken along the line 3—3 of FIG.
Figure 5:
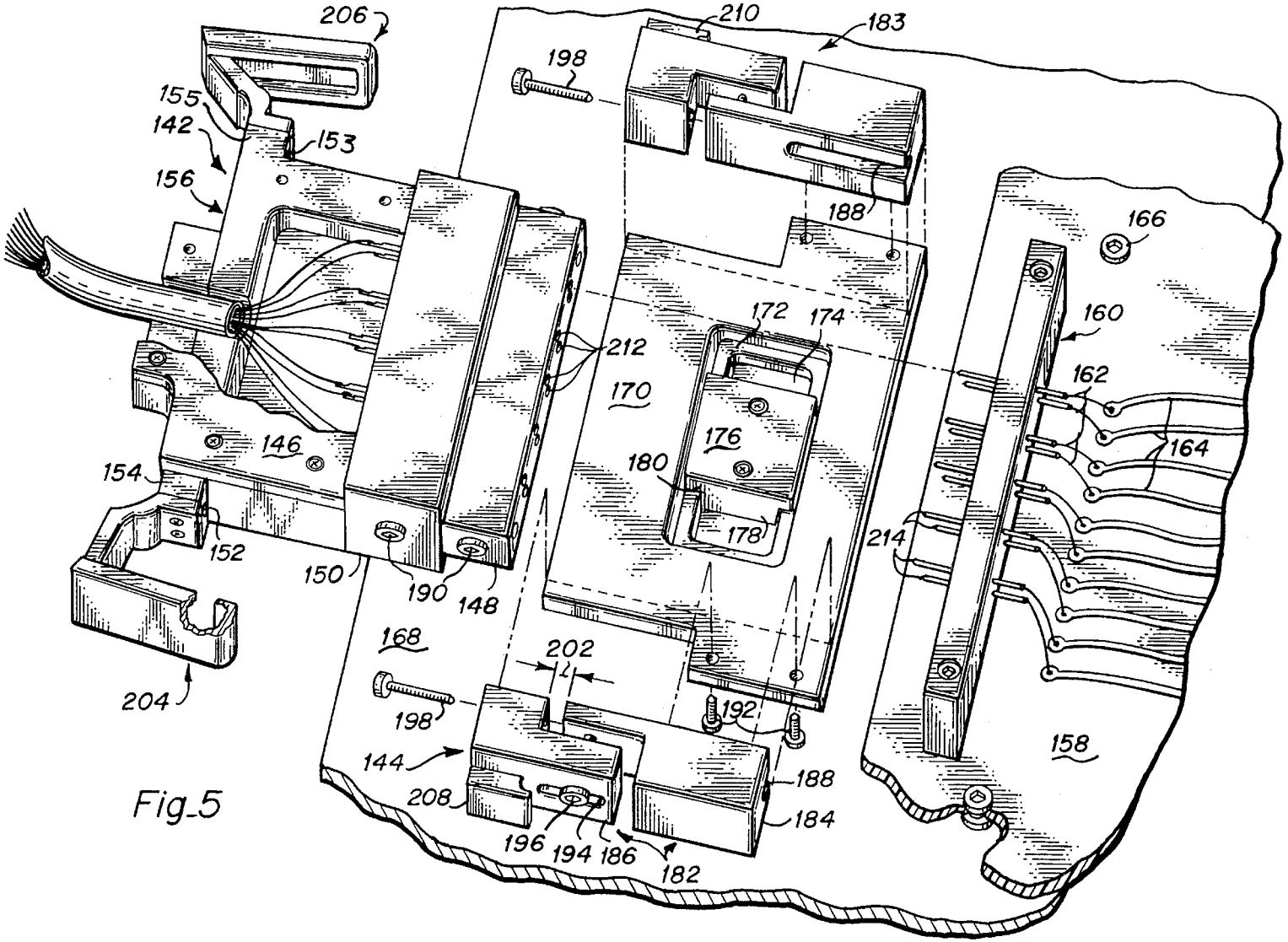
Figure 6:
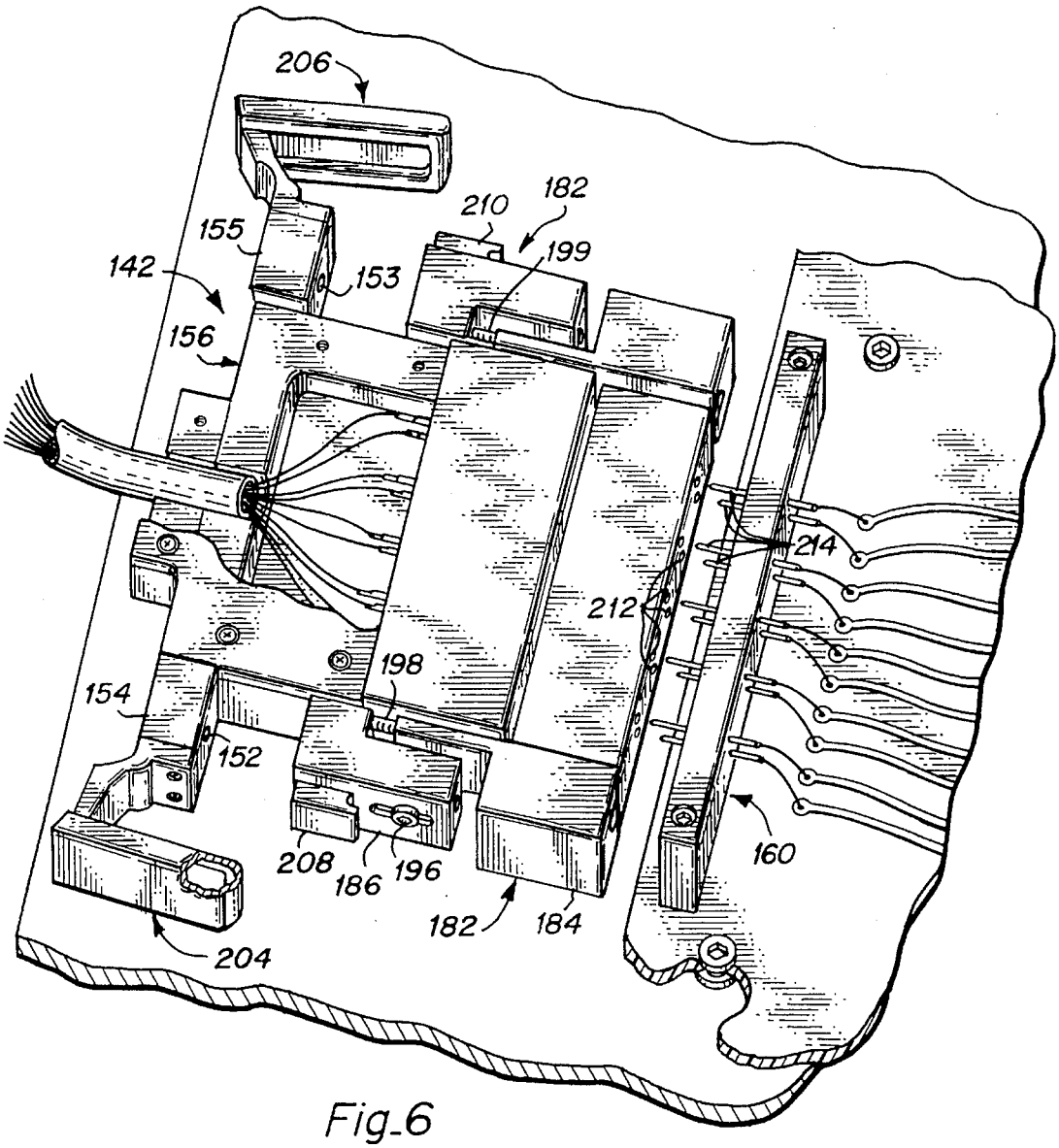

1 more clearly illustrating the pin-receiving receptacles and bores, and the details of the spring-loaded contactor assemblies included in the male connector assembly;

FIG. 3B illustrates the connector of FIG. 3A pulled into full engagement with the contact pins of the male connector assembly;

FIG. 4 is an enlarged cross-sectional view showing details of the contacting surfaces and manner of engagement of the male connector pin and end of the spring-loaded contactor of the female connector;

FIG. 5 is an exploded view of an alternative embodiment of the invention including a positioning block slidably mounted to a base plate for aligning a female connector assembly with a male connector assembly mounted to a circuit board which is affixed to the base plate; and FIG. 6 is an illustration of the assembled apparatus shown in FIG. 5.

DETAILED DESCRIPTION OF THE PREFERRED EMBODIMENT

Referring now to the first figure of the drawing, there is shown a female connector assembly 10 and a multipin male connector assembly 12, the female connector assembly having a body portion 14 and two identical sliding jaws 16 and 18 positioned on either side with hooked ends 20 and 22 protruding inwardly toward each other and shown in engagement with the male connector assembly 12. On the other end of the jaws there are outwardly hooked extensions 24 and 26 forming captivating recesses 28 and 30. Attached to extensions 36 and 38 protruding from opposite sides of the body 14 by suitable screw fasteners 31 are two identical levered, over-center acting clamps 32 and 34, each clamp having a cavity 40 including a hooked shaped recess 42 on the forward end 44 to make gripping engagement with the hooked extensions 24 and 26 of the jaws 16 and 18.

The sliding jaws 16 and 18 are held to the body 14 by bolts 46 that pass through slots 48 and 50 and are threaded into the sides of the body to guide and allow free movement of the jaws along the sides of body 14. The purpose of the jaws 16 and 18 is to position the female connector assembly 10 in proper alignment relative to the male connector assembly 12 such that the contact pins 52 of connector 12 are aligned with corresponding receptacles 54 of connector 10, and to work together with the clamps 32 and 34 to mate the female and male connector assemblies together. When the hooked ends 44 engaged with the recesses 28 and 30 of the jaws 16 and 18, the clamps 32 and 34 are operated by forcing them inward towards each other so as to pivot over a connecting linkage and retract the jaws away from the connector assembly 12, and at the same time force the body 14 of the connector 10 toward the connector 12 so as to cause the pins 52 to mate their corresponding receptacles 54. The sliding jaws 16 and 18 and clamps 32 and 34 thus simultaneously serve the purposes of aiding in the alignment of the connectors and providing leverage for ease of making the interconnection. The mechanical advantage supplied by the clamps is very important in multi-pin connectors wherein the small forces required for engagement of a single pin and receptacle are multiplied by the number of connections to cause substantial mechanical resistance to interconnection.

The body 14 includes a first receptacle housing 56 and a second receptacle housing 58, the two having various bores and counter bores housing contactor assemblies 60 partially revealed in the cut away section. Novel features of the first and second receptacle housings 56 and 58 and contactors 60 in use will be fully explained in the following figures of the drawing. The body 14 includes a rear portion 62 with a large centrally located cavity 64 and a semicircular cutout 66. A cover plate 68 is bolted to the rear portion 62 and to a cable clamp 70, the clamp also having a semicircular cutout 72 for passage of a cable assembly 74 leading into the cavity 64. The individual wires 76 of the cable 74 are each connected to an end 78 of a spring-loaded contactor assembly 60 of a type sometimes referred to as "pogo pins".

The male connector assembly 12 has a body portion 79 with bolt holes 81 for receiving bolts used to attach it to a surface such as a base plate 80. The body 79 provides insulative support for a plurality of connector pins 52 shown connected to wires from a cable 82. The male connector assembly could alternatively be bolted to a test card or circuit board with wires interconnecting the pins to circuit board traces.

The clamps 32 and 34 include a lever arm 84 containing the cavity 40, as previously explained, with hooked-shaped recesses 42 for engaging the captivating recesses 28 and 30 of the sliding jaws 16 and 18. Attached in a hinged manner at 88 to the other end of each lever 84 is a pivot arm 86. The other end of each pivot arm is connected to a block 90 bolted to the extensions 36 and 38 of the body 14 of the first connector assembly 10. It will be understood that the over-center latching assembly can be fabricated of discrete components pinned together with suitable pivot pins, or may be formed of a single molded plastic unit having "living hinges".

Figure 2:
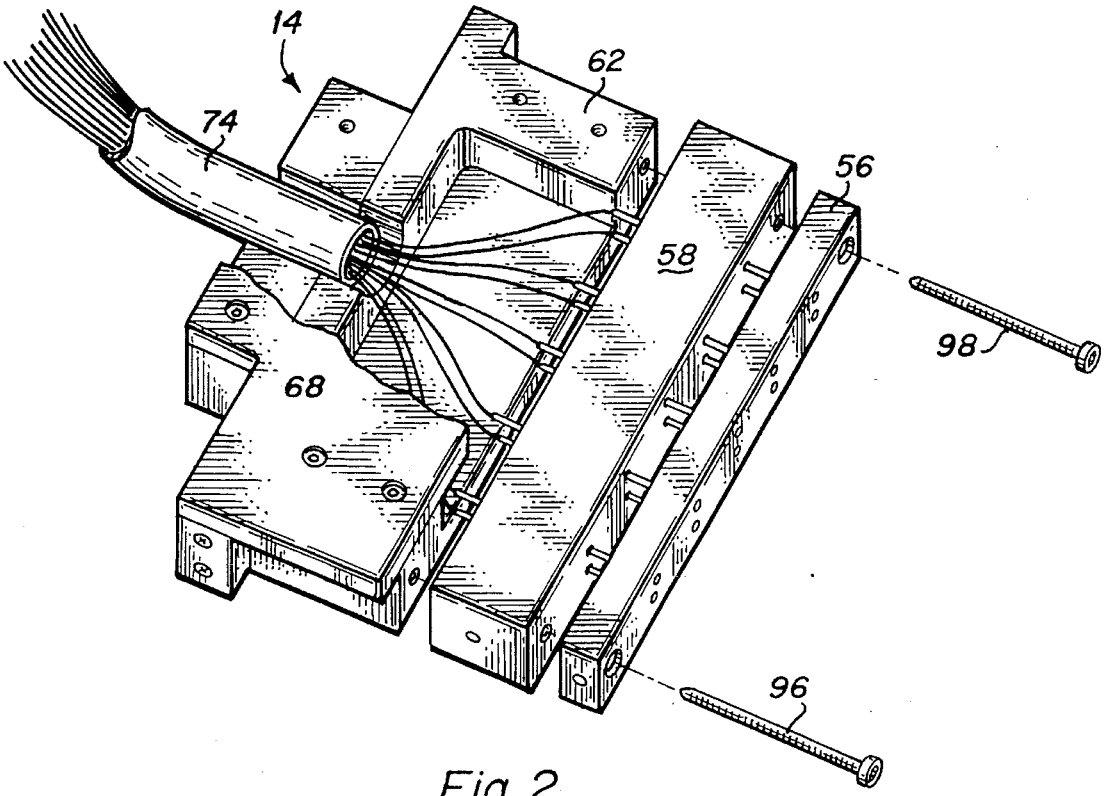
FIG. 2 is an exploded view more clearly illustrating the structure and component parts of the female connector assembly shown in FIG. 1.

Referring now to FIG. 2 of the drawing there is shown a partially exploded view of the body 14 in order to illustrate more clearly the interconnection of the first and second receptacle housings 56 and 58 and the rear housing 62 accomplished with bolts 96 and 98 on either side which pass through the first receptacle housing 56, second receptacle housing 58 and terminate in threaded engagement with the rear housing 62.

Figure 1:
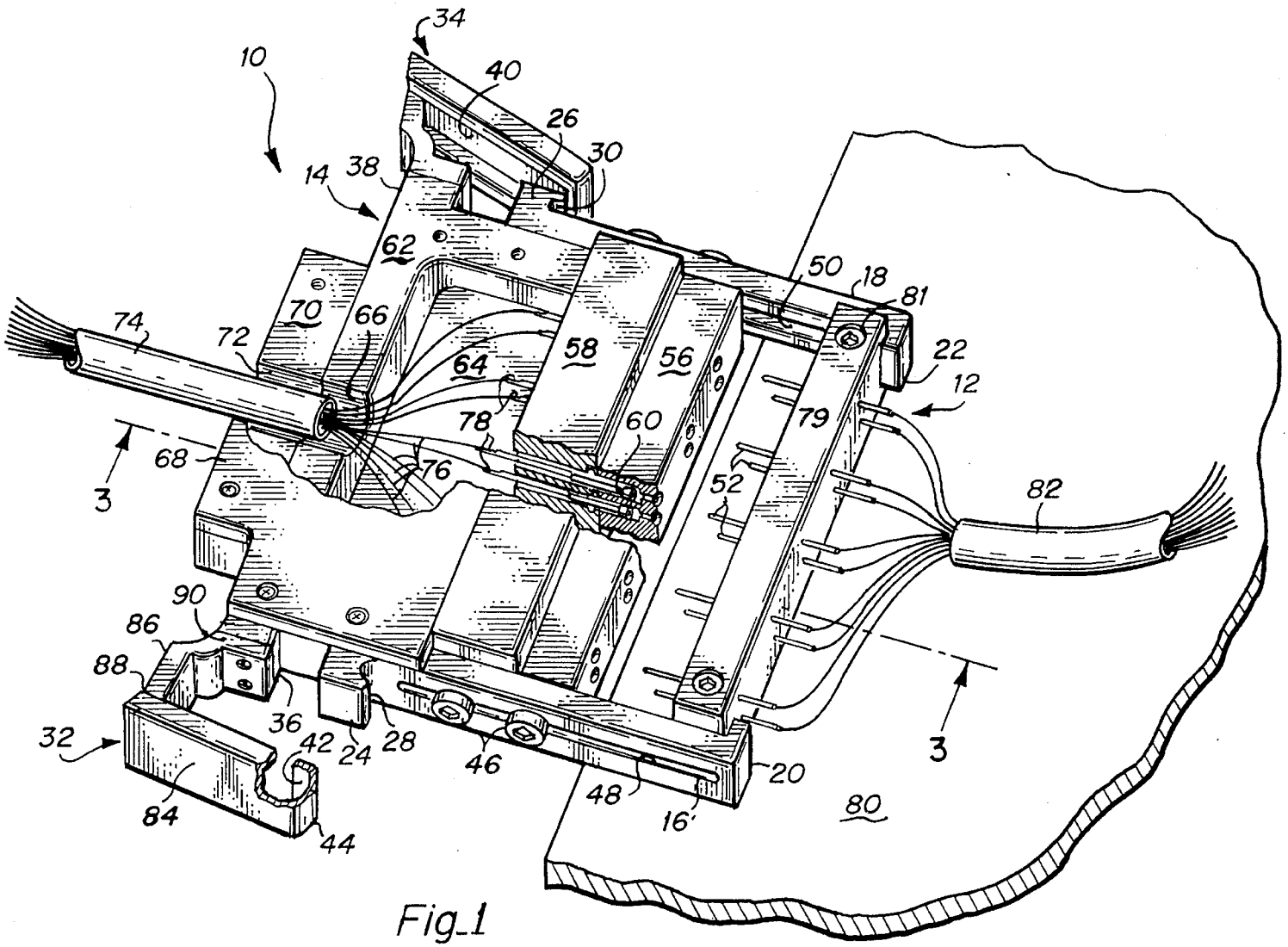
FIG. 1 is a partially broken illustration of a multipin connector assembly in accordance with the present invention and including a female connector assembly partially engaged with a multipin male connector assembly.

FIGS. 3A and 3B are sections taken along the line 3—3 of FIG. 1 of the drawing and show details of the spring-loaded contactor assemblies 60 and the bores and counterbores in the first and second receptacle housings 56 and 58. The figure also illustrates the engagement of the pins 52 of the male connector assembly 12 with the contactor assemblies 60. As previously mentioned, the female receptacle housing 56 has frusto-conical counter bores 100 formed in the forward surface 102 facing the pins 52 of the connector assembly 12 for receiving such pins as they are drawn into the receptacle housing, the taper serving to compensate for any slight misalignment of the pins 52 by guiding them into the pin alignment bore 104 and thence into the main bore 106 containing the contactor assembly 60. The contactor assembly 60 is comprised of a cylindrical tube 108 supported by the main bore 106 in the first receptacle housing 56 and further by the main bore 107 extending through the second receptacle housing 58. The counterbores 100, alignment bores 104 and main bores 106 and 107 make up the receptacle 54 referenced in FIG. 1. Coaxially extending from the end 126 of tube 108 is a contactor pin 132 biased forwardly by a compression spring 130 disposed in the opposite end of the tube. Note that a contact cap 136 is affixed to the distal end of rod 132. The opposite end of tube 108 is configured to form a terminal to which a wire 116 can be attached.

Captivation of the cylindrical tube 108 is provided by a counter bore 110 shown at the junction 112 between the first and second receptacle housings 56 and 58 for containment of an enlargement 114 in the diameter of the tube 108, the counterbore 110 being in the interfacing surface of the second receptacle housing 58. This counter bore 110 could alternately be placed in the mating surface of the first receptacle housing 56 with minor adjustments of the lengths of the first and second receptacle housings 56 and 58. The contactor assemblies 60 extend out the back of the second receptacle housing 58 into the cavity 64 of the rear housing 62 and have attached thereto wires 116 leading to the input cable 74.

FIG. 3B shows the body 14 moved forward to join with the connector assembly 12, the pins 52 being fully engaged with the contactor assemblies 60, the action being caused by the clamps 32 and 34 (only 32 shown) being engaged with the jaws 16 and 18 (18 not shown) and forced from a first position 120 as shown in FIG. 3A to a second, over-centered position 122 as shown in FIG. 3B.

FIG. 4 is an enlarged view showing the inter-relationship between the connector pin 52, the contact cap 136, the frusto-conical counterbore 100, and the bore 104, and illustrates a novel feature of the invention that enhances the likelihood of an effective electrical contact between the mating connector pin 52 and the contactor 60. The enlarged diameter of the counterbore 100 guides the pin into the pin guide bore 104, being particularly effective in the case of slightly misaligned pins 52 which might otherwise miss the guide bore 104 opening. Due to intentional tolerancing causing a slight misalignment, illustrated by the arrows 137, of the center line 135 of the pin guide bore 104 and the center line 139 of the contact rod 132, the pin 52 will initially make contact with only one inclined side of the notched or conical recess 138 in the contact cap 136. The compression supplied by the spring 130 (FIG. 3) and the tolerancing between the contact rod 132 and the tube 106 allows the tip 141 of the pin 52 to cause a lateral displacement of the cap 136 as it slides slightly on the surface of the recess 138 in the cap 136. This sliding motion and frictional engagement enhances the probability of a proper ohmic contact between the pin 52 and the contact cap 136 due to the slight abrasion of the surfaces caused by the sliding interference which tends to break through any accumulated oxide barrier. The spirit and function of the present invention also includes other types of angled or inclined contact surfaces which facilitate sliding between the pin 52 and the contact cap 136. For example, a concave depression 143 or chisel-faced cap surface 145 will also be effective for the same purpose. Additionally, other types of springs could be used in place of the coil spring 130, and the contact rod 132 and cap 136 could take on a variety of forms that could provide a spring-biased or resilient electrically conductive element with a slightly misaligned end for contacting a contact pin of a mating connector.

In FIG. 5 there is shown a partially exploded view of a second embodiment of the invention wherein a first connector assembly 142 is permanently attached in a sliding manner to a positioning block 144 that is attached to a large plate 146. The first connector assembly 142 of FIG. 5 is similar to the connector assembly 10 of FIG. 1 except for the omission of the sliding jaws 16 and 18. In addition, the cover plate 146 of FIG. 5 differs slightly from the cover plate 62 of FIG. 1 in that it is of the same transverse width as the first and second receptacle housings 148 and 150. Also, clearance holes 152 and 153 are provided through the extensions 154 and 155 of the body 156.

Also shown is a circuit board or test card 158 upon which is mounted a second connector assembly 160 with output leads 162 attached to circuit traces 164 on the test card 158, the purpose of the positioning block 144 being to facilitate alignment of the first connector assembly 142 relative to the second connector assembly 160, and for quick connect and disconnect operations, particularly applicable in those cases where a large number of test cards must be installed and removed from a test fixture. FIG. 5 shows the test card 158 being held with two bolts 166 to a large second base plate 168, but these bolts could also be some form of dowel pin and clamp arrangement so that the test cards can be quickly removed and replaced to facilitate the testing of many boards. FIG. 5 shows only one connector assembly 142 and mating connector 160, but any number of connecting units can be included on a single base plate 168.

The exploded view of the positioning block 144 includes a base plate 170 having a large rectangular opening projecting through a portion of the thickness, and a somewhat smaller rectangular opening 174 extending the rest of the way through the plate leaving a circumscribing shoulder 172. Positioned within this rectangular opening 174 is a rectangular guide block 176 that is bolted to the large base plate 168, the guide block 176 having a narrower bottom portion 178 that is dimensioned for a loose sliding fit in the rectangular opening and a wider rectangular upper portion 180 dimensioned to overlap the shoulder 172, thereby captivating the base plate 170 but allowing it to be moved laterally relative to base plate 168.

On each side of the plate 170 there are block assemblies 182 and 183 that are mirror images of each other. Assembly 182 is composed of a first block 184 and a second block 186, the first block 184 having a rectangular channel 188 provided in its inside face for the purpose of receiving the bolt heads 190 and guiding the first connector assembly 142 in a direction toward the second connector assembly 160. The rectangular channels 188 are dimensioned for a sliding fit for the bolt heads 190 that are shown on either side of the first and second receptacle housings 148 and 150 of the first connector assembly 142. The block 184 is bolted to the base plate 170 with the two bolts 192 as shown, although other bolting or attachment arrangements may be used. The second block 186 is connected to the first block 184 in a slidable fashion, accomplished by way of an elongated slot 194 in the block 186 and a bolt 196 passing therethrough and threadedly engaged with the block 184.

The movement of the block 186 relative to the block 184 is limited by a bolt 198 extending through an opening in the end 200 of the block 186 and tapped into the block 184. The adjustment of bolt 198 determines the maximum spacing 202 between the blocks, the adjustment being for the purpose of setting the tension of the clamps 204 and 206 of the connector assembly 142 when engaged with the hooked extensions 208 and 210 protruding from the blocks 186 and positioned for full interconnection of the connector assemblies. Other forms of clamps could also be fabricated to extend to the second connector assembly 160 or other fixed reference objects instead of to the positioning block.

FIG. 6 shows the completed assembly of FIG. 5. Adjustment of the block assembly 182 would proceed by moving the connector assembly 142 manually into position to align the receptacles 212 with the second connector pins 214 with the clamps 204 and 206 positioned over the hooked extensions 208 and 210. The bolts 198 and 199 are then accessed through the clearance holes 152 and 153 in the rear extensions 154 and 155 of the body 156 and adjusted so that when the clamps 204 and 206 are fully compressed inward, the proper tension is applied for forcing the connector assembly 142 into full mating position with the connector assembly 160. In this position, the bolts 196 securing the block 186 with the block 184 are tightened and the connector system is ready for full operation.

The above disclosed embodiments are by way of example only, with the understand that other modifications and construction methods will no doubt be apparent to those skilled in the art after having read the above disclosure. It is therefore intended that the following claims be interpreted as covering all such alterations and modifications as fall within the true spirit and scope of the invention.

What I claim is:

1. A multipin connector assembly comprising:

a first connector assembly including a first plurality of electrically conductive contact pins, a first connector body for insulatively supporting said contact pins, and means for mounting said first connector assembly on a surface; and a second connector assembly including a second connector body having a plurality of contactors each including an electrically conductive element with a contact surface forming a first end for making contact with one of the contact pins, spring loading means for providing a spring force resisting motion of said element when said element is pressured on said first end, and wire interconnection means for electrically interconnecting a wire to said element, a plurality of receptacles formed within said second body, each said receptacle containing one of the contactors and a means for guiding one of the contact pins to the contactor contained in the receptacle, and a rear housing assembly for receiving a cable assembly and for containing cable wires for connection with said interconnection means, and clamp means attached to said second body having means for gripping said first connector body and configured so that upon gripping said first connector body, and user activation of said clamp means, a leveraged force is exerted thrusting said second body towards said first connector body so as to cause said contact pins to be inserted in said receptacles and to make contact with said contactors.

2. A multipin connector assembly as recited in claim 1 wherein said means for guiding includes:

a plurality of conically tapered counterbores in an exterior surface of said second body, each associated with one of said receptacles for directing one of the contact pins toward a contactor, and an alignment bore concentric with the conically tapered counterbore for receiving and further aligning and straightening the contact pin guided by the conically tapered counterbore.

3. A multipin connector assembly as recited in claim 2 and further comprising:

means for causing the contact pins to make a sliding engagement with the first end of the contactors so as to enhance the probability of optimum electrical contact.

4. A multipin connector assembly as recited in claim 3 wherein the contact surfaces forming said first ends are oriented non-orthogonally to the axes of the alignment bores.

5. A multipin connector assembly as recited in claim 4 wherein said contact surfaces are in the form of conical recesses with the centers of the conical recesses defining conical axes; and wherein the conical axis of each contactor is located off-center relative to the corresponding axis of each alignment bore so as to cause the contact pin to initially make sliding contact with one side of the conical recess.

6. A multipin connector assembly comprising:

a base plate;

a first connector assembly interconnected to said base plate and including a first plurality of electrically conductive contact pins, a first connector body for insulatively supporting said contact pins, and means for mounting said first connector assembly on a surface;

a second connector assembly including a second connector body having a plurality of contactors each including an electrically conductive element with a contact surface forming a first end for making contact with one of the contact pins, spring-loading means for providing a spring force resisting motion of said element when said element is pressured on said first end, and wire interconnection means for electrically interconnecting a wire to said element, a plurality of receptacles formed within said second body, each said receptacle containing one of the contactors and a means for guiding one of the contact pins to the contactor contained in the receptacle, and a rear housing assembly for receiving a cable assembly and for containing cable wires for connection with said interconnection means;

a positioning block means mounted to said base plate including means for slidably mounting said second connector assembly so that it is movable towards said first connector assembly in a direction for engagement of said contact pins with said receptacles, and means for moving said second connector assembly in a direction orthogonal to said direction for engagement so as to allow the alignment of the contact pins with the means for guiding; and clamp means attached to said second body and having means for gripping a portion of said block means for providing, upon user activation, a leveraged force causing said second body to be thrust towards said first connector body, whereby the contact pins are engaged with said means for guiding and are guided into said second body so as to make electrical contact with the contactors.

7. A multipin connector assembly as recited in claim 6 wherein said means for guiding includes a plurality of conically tapered counterbores in an exterior surface of said second body each associated with one of said receptacles for directing one of the contact pins toward a contactor, and an alignment bore concentric with the conically tapered counterbore for receiving and further aligning and straightening the contact pin guided by the conically tapered counterbore.

8. A multipin connector assembly as recited in claim 7 and further comprising:

means for causing the contact pins to make a sliding engagement with the first end of the contactors so as to enhance the probability of optimum electrical contact.

9. A multipin connector assembly as recited in claim 8 wherein the contact surfaces forming said first ends are oriented non-orthogonally to the axes of the alignment bores.

10. A multipin connector assembly as recited in claim 9 wherein said contact surfaces are in the form of conical recesses with the centers of the conical recesses defining conical axes; and wherein each said conical axis is located off-center relative to the axis of each alignment bore so as to cause the contact pin aligned by the alignment bore to make initial contact in a sliding manner with one side of the conical recess.

11. A female multipin connector assembly for interconnection with a mating male connector having a plurality of electrically conductive contact pins and a connector body for insulatively supporting the contact pins and mounting the connector body to a surface, said multipin connector assembly comprising:

a female connector body having a plurality of contactors each including an electrically conductive element with a contact surface forming a first end for making contact with one of the contact pins, spring-loading means for providing a spring force resisting motion of said element when said element is pressured on said first end, and wire interconnection means for electrically interconnecting a wire to said element, a plurality of receptacles formed within said female connector body, each said receptacle containing one of the contactors and pin guide means for guiding one of the contact pins to the contactor contained in the receptacle, and a rear housing assembly for receiving a cable assembly and for containing cable wires for connection with said interconnection means;

slide means for guiding said female connector body towards said mating male connector; and clamp means attached to said female connector body and having means for gripping said slide means and configured so that user activation of said clamp means causes a leveraged force to be exerted thrusting said female connector body towards said male connector so as to cause said contact pins to be inserted into said receptacles to make contact with said contactors.

12. A multipin connector assembly as recited in claim 11 wherein said pin guide means includes a conically tapered counterbore in an exterior surface of said body for directing a contact pin toward a contactor, and an alignment bore concentric with the conically tapered counterbore for receiving and further aligning and straightening a contact pin input to said guide means.

13. A multipin connector assembly as recited in claim 12 further comprising:

means for causing the contact pins to make sliding engagement with the first end of the contactors so as to enhance the probability of optimum electrical contact.

14. A multipin connector assembly as recited in claim 13 wherein said first ends are contact surfaces oriented non-orthogonally to the axes of the alignment bores.

15. A multipin connector assembly as recited in claim 14 wherein said contact surfaces are in the form of conical recesses with the centers of the conical recesses defining conical axes; and wherein the conical axis of each contactor is located off center relative to the corresponding conical axis of each alignment bore so as to cause the contact pin to initially make sliding contact with one side of the conical recess.

16. A circuit board connector interconnection system comprising:

a base plate having means for mounting a circuit board/test card, said circuit board having one or more mating connectors mounted thereon, said mating connectors each having a plurality of electrically conductive contact pins and a connector body for insulatively supporting the contact pins, and having means for mounting to the circuit board;

one or more connector assemblies, each corresponding to one of the mating connectors, each connector assembly including a body having a plurality of contactors each including an electrically conductive element with a contact surface forming a first end for making contact with one of the contact pins, spring-loading means for providing a spring force resisting motion of said element when said element is pressured on said first end, and wire interconnection means for electrically interconnecting a wire to said element, a plurality of receptacles formed within said body, each said receptacle containing one of the contactors and a means for guiding one of the contact pins to the contactor contained in the receptacle, and a rear housing assembly for receiving a cable assembly and for containing cable wires for connection with said interconnection means;

one or more positioning block means, each mounted to said base plate adjacent to one of said mating connectors, each positioning block including means for slidably mounting one of said connector assemblies so as to be movable towards said mating connector in a direction for engagement of said contact pins with said receptacles, and means for moving said connector assembly in a direction orthogonal to said direction for engagement so as to allow the alignment of the contact pins with the means for guiding; and clamp means attached to each of the bodies having means for gripping the corresponding positioning block and for providing, upon user activation of the clamp means of a selected connector assembly, a leveraged force causing the body to be thrust towards the mating connector, whereby the contact pins are engaged with the means for guiding and are guided into the body so as to make electrical contact with the contactors.

17. A circuit board connector interconnection system as recited in claim 16 wherein said means for guiding includes:

a plurality of conically tapered counterbores in an exterior surface of said body each associated with one of said receptacles for directing one of the contact pins toward a contactor; and an alignment bore concentric with the conically tapered counterbore for receiving and further aligning and straightening the contact pin guided by the conically tapered counterbore.

18. A circuit board connector interconnection system as recited in claim 17 further comprising:

means for causing the contact pins to make a sliding engagement with the first end of the contactors so as to enhance the probability of optimum electrical contact.

19. A circuit board connector interconnection system as recited in claim 18 wherein said means for causing includes the contact surfaces forming the first ends being oriented non-orthogonally to the axes of the alignment bores.

20. A circuit board connector interconnection system as recited in claim 19 wherein said contact surfaces are in the form of conical recesses with the centers of the conical recesses defining conical axes; and wherein the conical axis of each contactor is located off center relative to the corresponding axis of each alignment bore so as to cause the contact pin to initially make sliding contact with one side of the conical recess.

21. A multipin connector assembly system comprising:

a first connector assembly including a plurality of contact pins, a first connector body for insulatively supporting the contact pins, and means for mounting said first connector assembly to a surface;

a second connector assembly including a second connector body having an elongated frontal surface joined by two sides each intersecting one of two narrow ends of said frontal surface, said second connector body having a plurality of contactors having an electrically conductive element with a first end for making contact with a pin, spring-loading means for providing a spring force resisting motion of said element when said element is pressured on said first end, and wire interconnection means for electrically interconnecting a wire to said element, a plurality of receptacles formed within said second connector body, each receptacle containing one of the contactors, and a means for guiding a pin to the contactor contained in the receptacle, and a rear housing assembly for receiving a cable assembly and for containing cable wires for connection with said interconnection means;

a pair of sliding jaws each having an elongated slot therethrough for passage of bolt means for slidably mounting on one of the sides of said second connector body, each having a forward end extending beyond said frontal surface, said jaws having inwardly shaped hooked ends on said forward ends for grippingly engaging said first connector assembly, and said sliding jaws having hooked outward extensions projected away from said sides of said second connector body on ends oppositely disposed to said hooked ends; and clamp means disposed at a location for engaging said hooked extensions of said sliding jaws, whereby when said hooked ends of said jaws are grippingly engaged with said first connector assembly and said clamp means are engaged with said outward extensions of said jaws and a closing force is applied, said second connector body is thrust in a forward direction toward the contact pins extending from said first connector assembly, the pins being guided by said conically tapered counterbores and said means for aligning so as to make contact with said contactors.

22. A multipin connector assembly as recited in claim 6 wherein said positioning block means further includes:

first block means having hooked extension means for providing said structure for gripping engagement with said clamp means, and adjustment means for setting the distance of the hooked extension means from said mating connector so as to allow adjustment of the tension of said clamp means when said first and second connectors are fully mated.

23. A circuit board connector interconnection system as recited in claim 16 wherein said positioning block means further includes:

first block means having hooked extension means for providing said means for gripping of said clamp means, and adjustment means for setting the distance of the hooked extension means from said mating connector so as to allow adjustment of the tension of said clamp means when said first and second connectors are fully mated.

* * * * *